US008089441B2

(12) United States Patent
Lee et al.

(10) Patent No.: US 8,089,441 B2
(45) Date of Patent: Jan. 3, 2012

(54) LIQUID CRYSTAL DISPLAY APPARATUS AND DRIVING METHOD THEREFOR

(75) Inventors: Chang-Hun Lee, Gyeonggi-do (KR); Eun-Hee Han, Seoul (KR); Jun-Woo Lee, Gyeonggi-do (KR)

(73) Assignee: Samsung Electronics Co., Ltd. (KR)

( * ) Notice: Subject to any disclaimer, the term of this patent is extended or adjusted under 35 U.S.C. 154(b) by 906 days.

(21) Appl. No.: 11/710,185

(22) Filed: Feb. 23, 2007

(65) Prior Publication Data

US 2007/0200807 A1 Aug. 30, 2007

(30) Foreign Application Priority Data

Feb. 24, 2006 (KR) ..... 10-2006-0018061

(51) Int. Cl.
*G09G 3/36* (2006.01)

(52) U.S. Cl. ..... 345/88; 345/87; 345/89; 345/102; 345/690

(58) Field of Classification Search ..... 345/87, 345/102, 88, 89, 690
See application file for complete search history.

(56) References Cited

U.S. PATENT DOCUMENTS

| | | | | |
|---|---|---|---|---|
| 6,317,112 | B1 * | 11/2001 | Handschy et al. | 345/89 |
| 6,392,620 | B1 * | 5/2002 | Mizutani et al. | 345/88 |
| 6,570,554 | B1 * | 5/2003 | Makino et al. | 345/102 |
| 6,803,894 | B1 * | 10/2004 | Hirota et al. | 345/88 |
| 2002/0057253 | A1 * | 5/2002 | Lim et al. | 345/102 |
| 2004/0246275 | A1 * | 12/2004 | Yoshihara et al. | 345/690 |
| 2006/0017713 | A1 * | 1/2006 | Lee et al. | 345/204 |
| 2007/0222743 | A1 * | 9/2007 | Hirakata | 345/102 |
| 2010/0103205 | A1 * | 4/2010 | Iisaka et al. | 345/690 |

* cited by examiner

*Primary Examiner* — Lun-Yi Lao
*Assistant Examiner* — Priyank Shah
(74) *Attorney, Agent, or Firm* — Innovation Counsel LLP

(57) ABSTRACT

A driving section for a liquid crystal display (LCD) panel not requiring color filters supplies the LCD panel with a plurality of first image signals based on an original image signal during a plurality of first, equal-length field intervals of a frame and also provides a second image signal for enhancing luminance during a second field interval that is longer than the first time interval. The 4-field driving method supplies RGBW data so that the field time interval for a white data is assured thereby improving response speed, charging ratio and transmittance of the liquid crystal molecules.

20 Claims, 13 Drawing Sheets

LIQUID CRYSTAL DISPLAY APPARATUS AND DRIVING METHOD THEREFOR

CROSS-REFERENCE TO RELATED APPLICATIONS

This application relies for priority upon Korean Patent Application No. 2006-18061 filed on Feb. 24, 2006 in the Korean Intellectual Property Office, the contents of which are herein incorporated by reference.

FIELD OF THE INVENTION

The present invention relates to a liquid crystal display (LCD) apparatus having enhanced luminance characteristics and a method for driving the LCD apparatus.

DESCRIPTION OF THE RELATED ART

Generally, a liquid crystal display (LCD) apparatus includes a color filter LCD apparatus that displays multi-color images or full-color images using light that is selectively transmitted through three color filters of the display pixel elements. However the use of three color filters reduces the resolution of the display by about ⅓ also reduces light transmittance or luminance compared to a black-and-white LCD apparatus. A sequential color LCD apparatus dispenses with the color filters LCD by using a backlight assembly that has a plurality of light-emitting diodes (LEDs). That is, the sequential color driving type LCD apparatus displays a mixture-color image through a red light beam, green light beam and blue light beam during the time interval of each frame. However, the light transmittance of the color filter-less LCD apparatus is lower than that of the color filter LCD apparatus due to the slower response time of the LCD panel because of the shorter charging time determined by a high frequency driving required for the three colors.

However, even if there were sufficient charging time, a black time interval is required between each color in order to prevent the color bleeding. Therefore, the time interval of each colors is less than about ⅓ frame.

In order to solve the color breaking that problem in the color filter-less LCD apparatus, a four field driving method that sequentially drives RGBW (that is, red, green, blue and white) has been developed. However, the charging time of each field and the response time of the liquid crystal are still decreased resulting in poorer light transmittance.

Recently, an optical compensated birefringence (OCB) mode has been suggested in order to improve the viewing angle of the LCD apparatus and the response speed of the LCD apparatus. A predetermined time interval is needed in the OCB mode LCD apparatus in order to obtain the bend alignment state. It is known that the OCB mode LCD apparatus has features including high response speed and wide viewing angle after the liquid crystal molecules gradually bend to an orientation substantially perpendicular to opposite substrates.

SUMMARY OF THE INVENTION

The present invention provides a liquid crystal display (LCD) apparatus having enhanced luminance by securing a field time interval of a white data, in a color filter-less LCD apparatus driven by a 4-field driving method.

According to one aspect of an illustrative embodiment, an LCD display includes a driving section that provides the LCD panel with a plurality of first image signals based on an original image signal from an external device and a second image signal to enhance luminance during a second field interval that is longer than the first time interval within the frame. The second field interval may be earlier or later than the first field interval.

The liquid crystal layer may advantageously be an optical compensated birefringence (OCB) mode liquid crystal. The first image signals may include red, green, and blue data and the second image signal may include white data. Each of the first image signals may further include black data. On the other hand, for example, two of the red data, the green data and the blue data may be sent to the LCD panel during a field interval.

A light providing section includes a red light beam emitting element for the red data, a green light beam emitting element for the green data and a blue emitting element emitting a blue light beam for the blue data during three respective field intervals among five field intervals of a frame, and emit a white light beam during the remaining two field intervals. Particularly, the red, green and blue light emitting elements may emit their respective colors during about 2.34 milliseconds (ms) of the three field intervals, and may emit a white light beam through mixing the red, green and blue light beams during about 4.84 ms of the two field intervals.

According to another aspect of the illustrative embodiment, a first image signal is sent to the data lines and a gate signal is sent to the gate lines during a plurality of first, equal-length field intervals within the frame. The first image signal is generated based on the original image signal that is provided from an external device. The gate signal activates the gate line for charging the first image signal to the pixel. Then, a second image signal is sent to the data lines and a gate signal is sent to the gate lines during a second field interval that is longer than the first time interval within the frame. The second image signal enhances luminance based on the original image signal. The gate signal activates the gate line for charging the second image signal to the pixel. The original image signal may include red data of a first level, green data of a second level and blue data of a third level, and the second field interval may be defined by data having a minimum level of the first, second and third levels.

According to one aspect of the illustrative embodiment, the original image signal may include a red data of a first level, a green data of a second level and a blue data of a third level while the second image signal may have a voltage level corresponding to the minimum level of the first, second and third color data. Here, the first image signal may include two color data that are defined by a level exceeding the minimum level data and a charging time exceeding the minimum level data. The second image signal is defined by the minimum level and the second field interval.

According to one aspect of the illustrative embodiment, first color data having the minimum charging quantity is extracted from the original image data. Then, the charging quantity of the first color data is subtracted from each of a remaining color data of the original image signal. Then, the charging level of the remaining color data is defined by the subtracted charging quantity and the first field interval. Then, the remaining color data having the defined charging level is sent to the data line during the first field interval.

According to the above, the color filter-less LCD apparatus having a 4-field driving method that excites RGBW data employs an OCB mode liquid crystal, so that the field time interval corresponded to white data is ensured so that response speed, charging ratio and transmittance of the OCB mode liquid crystal molecules are improved.

BRIEF DESCRIPTION OF THE DRAWING

The above and other advantages of the present invention will become readily apparent by reference to the following detailed description when considered in conjunction with the accompanying drawing, in which.

DESCRIPTION

Figure 1:
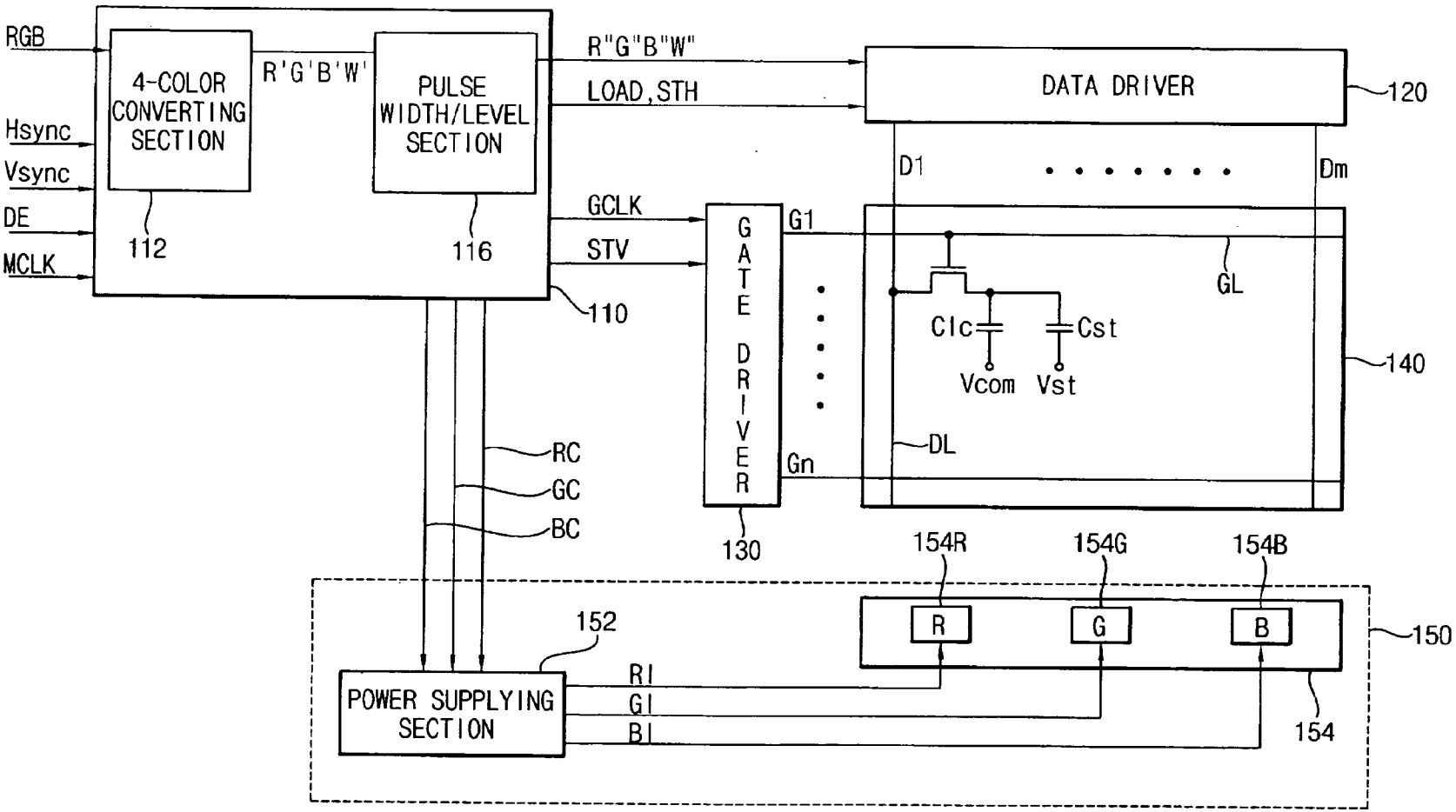
FIG. 1 is a block diagram illustrating a liquid crystal display apparatus according to one exemplary embodiment of the present invention.

FIG. 1 is a block diagram illustrating a liquid crystal display apparatus according to one exemplary embodiment of the present invention. Particularly, a liquid crystal display apparatus including a backlight assembly with RGB emitting elements is illustrated.

FIG. 1 shows a timing controller 110, a data driving section 120, a gate driving section 130, an LCD panel 140, and a light emitting section 150. Timing controller 110, data driving section 120 and the gate driving section 130 correspond to the driving apparatus that provides the LCD panel 140 with an image signal.

Timing controller 110 receives an original image signal RGB, various synchronizing signals Hsync and Vsync, a data enable signal DE and a main clock signal MCLK from an external device such as a graphic controller. Hsync denotes a horizontal synchronizing signal, and Vsync denotes a vertical synchronizing signal.

Timing controller 110 provides data driving section 120 with image signals R"G"B"W" having an enhanced luminance and data driving signals LOAD and STH for outputting the image signals R"G"B"W". LOAD controls the loading of the second data signal DATA2, and STH denotes a horizontal start signal that controls the start of a horizontal line.

Timing controller 110 includes, for example, a 4-color converting section 112 and a pulse width/level converting section 114 to convert the original image signal RGB into a luminance enhanced image signal R"G"B"W". The 4-color converting section 112 and pulse width/level converting section 114 are separately described in logical terms for ease of understanding, they are not necessarily separate physical hardware elements.

The 4-color converting section 112 converts the original image signal RGB into a 4-color image signal R'G'B'W', and provides pulse width/level converting section 114 with the converted 4-color image signal R'G'B'W'.

Pulse width/level converting section 114 converts the width and level of the 4-color image signal R'G'B'W', emphasizes white data, and generates luminance enhanced image signal R"G"B"W". Pulse width/level converting section 114 provides data driving section 120 with the luminance enhanced image signal R"G"B"W". The luminance enhanced image signal R"G"B"W", for example, correspond to three first field intervals having the same time interval within a frame and a second field interval that is longer than the first field interval. Particularly, two color data of the red, green and blue data correspond to the two first field intervals, and the white data corresponds to the second field interval.

Timing controller 110 provides date driving section 130 with gate driving signals GCLK and STV and gate turn-on/off voltages VON and VOFF. GCLK denotes a gate clock signal, and STV denotes a vertical start signal representing the start of a frame. The gate turn-on voltage VON activates (turns on) a switching element formed on LCD panel 140. The gate turn-off voltage VOFF de-activates (turns off) the switching element. The switching element advantageously includes an amorphous silicon thin-film transistor (a-Si TFT).

Timing controller 100 provides the light emitting section 150 with a red light control signal GC, a green light control signal GC and a blue light control signal BC in response to the vertical start signal STV. The vertical start signal STV denotes a synchronization signal that instructs the start of a frame.

Data driving section 120 converts the luminance enhanced image signal R"G"B"W" provided from timing controller 110 into a plurality of data voltages (or pixel voltage) D1, . . . , Dm, and provides the plurality of data lines with the data voltages. Here, 'm' is a natural number or a multiple number of three.

Gate driving section 130 sequentially provides the plurality of gate lines with the gate signal G1, . . . , Gn activating the gate lines in response to the gate driving signals GCLK and STV.

LCD panel 140 includes an array substrate (not shown), an opposite substrate (not shown) and a liquid crystal layer (not shown) that is disposed between the array substrate and the opposite substrate.

The array substrate (not shown) includes a plurality of gate lines transferring gate signals (or scan signals) G1, . . . , Gn, a plurality of data lines transferring the data signals D1, . . . , Dm and pixel sections that are formed in areas that are defined by two adjacent gate lines and two adjacent data lines. Each of the pixel sections includes a switching element (TFT) and a pixel electrode (not shown) that is electrically connected to the switching element (TFT).

The opposite substrate (not shown) includes a transparent substrate. The opposite substrate may further include a common electrode (not shown) facing the pixel electrode. The pixel electrode, common electrode and liquid crystal layer that is disposed between the pixel electrode and the common electrode define a liquid crystal capacitor Clc.

The liquid crystal layer includes OCB mode liquid crystal molecules that are driven after the state of the liquid crystal molecules is converted into a bend state. That is, the initial alignment state of the liquid crystal layer is maintained in a homogenous alignment state. When a predetermined voltage is applied to the lower and upper electrodes, the homogenous alignment state of the liquid crystal molecules is successively changed into a transient splay alignment state (Ts), an asymmetric splay alignment state (As) and a bend alignment state (Bs). The liquid crystal molecules changed into the bend alignment state (Bs) are operated in the OCB mode.

Light emitting section 150 includes a power supply section 152 and a light emitting part 154. A red light beam, a green light beam and a blue light beam exit from the light emitting section 150, in response to the red light control signal GC, the green light control signal GC and the blue light control signal BC that are provided from timing controller 110.

Power supply section 152 provides a first current Rl for emitting a red light beam, a second current Gl for emitting a green light beam and a third current Bl, respectively, in response to the red, green and blue light beam control signals GC, GC and BC.

Light emitting part 154 includes a red light emitting element 154R, a green light emitting element 154G and a blue light emitting element 154B. A light element includes a light emitting diode (LED). The red light emitting element 154R provides the liquid crystal display panel 140 with a red light beam in response to the first current Rl. The green light emitting element 154G provides the liquid crystal display panel 140 with a green light beam in response to the second current Gl. The blue light emitting element 154B provides the liquid crystal display panel 140 with a blue light beam in response to the third current Bl.

Figure 2:
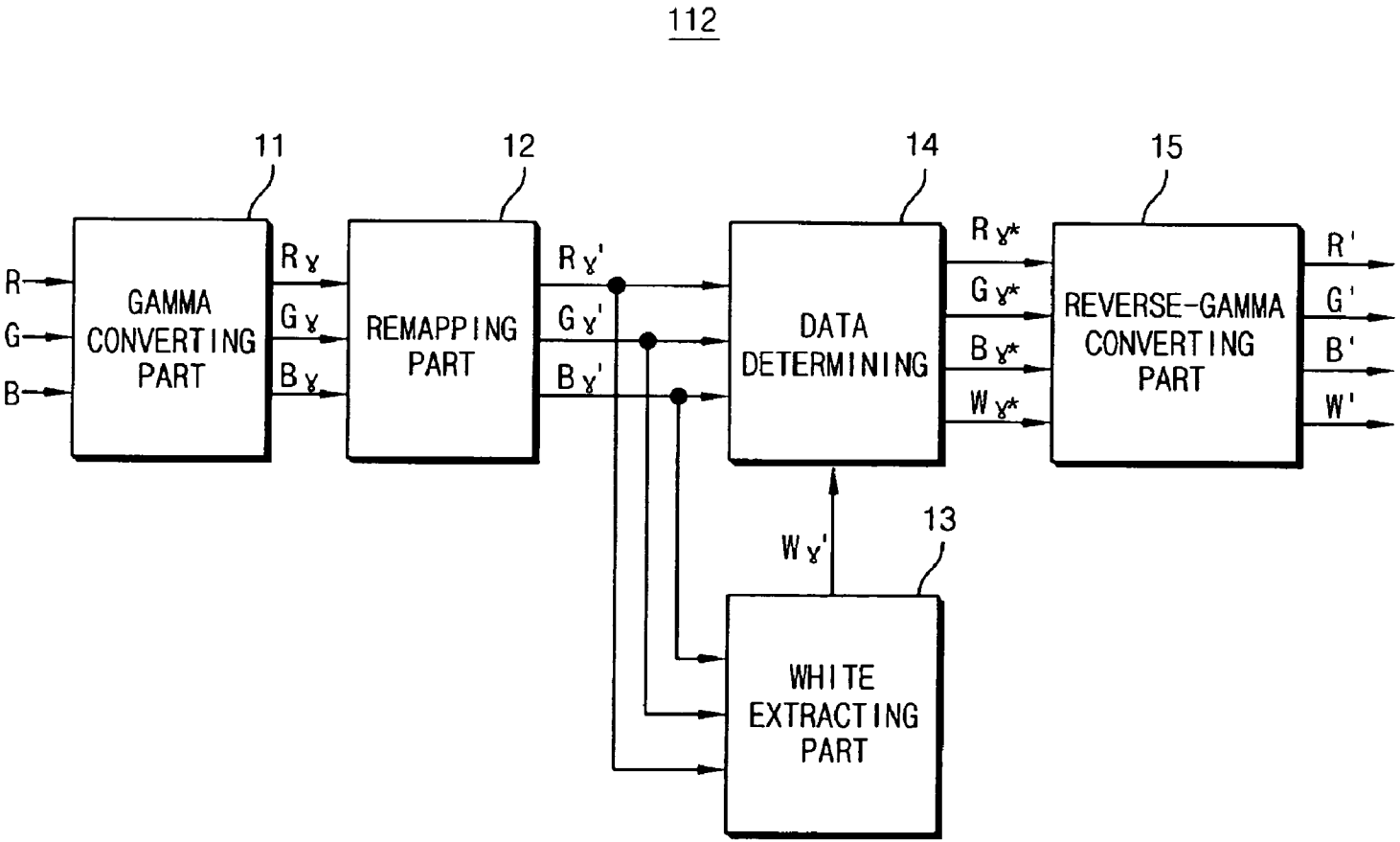
FIG. 2 is a block diagram illustrating one exemplary embodiment of the 4-color converting section in FIG. 1.
Figure 3A:
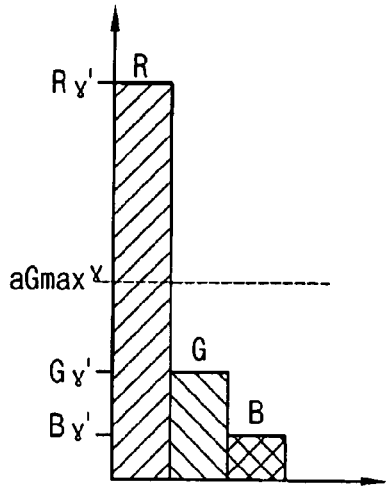
FIGS. 3A and 3B are graphs for describing extraction of a white component as described in FIG. 2.
Figure 3B:
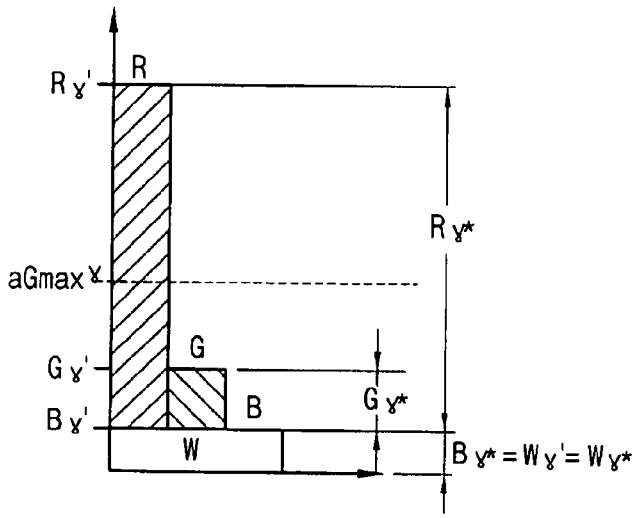

FIG. 2 is a block diagram illustrating one exemplary embodiment of the 4-color converting section of FIG. 1. FIGS. 3A and 3B are graphs for describing the extraction of a white component as described in FIG. 2.

Referring to FIG. 2, the 4-color converting part 112 includes a gamma converting part 11, a remapping part 12, a white extracting part 13, a data determining part 14 and a reverse-gamma converting part 15. The 4-color converting part 112 receives original RGB gray-scale data and converts it into 4-color RGBW gray-scale data.

Gamma converting part 11, the remapping part 12, the white extracting part 13, the data determining part 14 and the reverse-gamma converting part 15 are separately described in logical terms for ease of understanding, they are not necessarily separate physical hardware elements.

Gamma converting part 11 receives the original RGB gray-scale data and converts the original RGB gray-scale data into gamma-converted RGB data $R_\gamma$, $G_\gamma$ and $B_\gamma$. Then, gamma converting part 11 provides remapping part 12 with gamma-converted RGB data $R_\gamma$, $G_\gamma$ and $B_\gamma$, Each color data of the original RGB data is converted into each color data of the gamma-converted RGB data as shown below in Expression 1.

$$R\gamma = aR^\gamma$$

$$G\gamma = aR^\gamma$$

$$R\gamma = aB^\gamma \qquad \text{Expression 1}$$

Here, $R_\gamma$, $G_\gamma$ and $B_\gamma$ are normalized luminance data of R color, G color and B color, respectively, with respect to the maximum luminance of a corresponding one of the colors. Also, "a" denotes $(1/G_{max})\gamma$, and R γ, G γ and B γ are gray-scale numbers corresponding to R color, G color and B color, respectively. "$G_{max}$" denotes a maximum gray-scale level. For example, when the full gray-scale of RGB data is "64," its $G_{max}$ is "63."

Remapping part 12 receives the gamma-converted RGB data and performs multiplication and remapping with respect to each color data of the gamma-converted RGB data. For example, remapping part 12 multiplies each color data $R_\gamma$, $G_\gamma$, $B_\gamma$ of the gamma-converted RGB data by scaling factor "2" as shown below in Expression 2. The remapping part 12 then provides the remapped RGB data to the white extracting part 13 and the data determining part 14.

$$R\gamma' = SR\gamma$$

$$G\gamma' = SG\gamma$$

$$B\gamma' = SB\gamma \qquad \text{Expression 2}$$

Here, "S" denotes a scaling factor, a ratio of the maximum luminance of white obtained from composition of RGB colors to the maximum luminance of white obtained from composition of RGBW colors. The scaling factor S is preferably "2" when a color filter is used.

White extracting part 13 receives the remapped RGB data and extracts a white color component from the remapped RGB data in consideration of its respective color data $R_\gamma'$, $G_\gamma'$, $B_\gamma'$. The white color component is then provided to data determining part 14.

For example, when the minimum luminance of the color data $R_\gamma'$, $G_\gamma'$, $B_\gamma'$ of the remapped RGB data is smaller than $aG_{max}\gamma$, the minimum luminance of the color data $R_\gamma'$, $G_\gamma'$, $B_\gamma'$ becomes the white color component $W_\gamma'$ that is supplied to data determining part 14. The remaining data except the minimum luminance of the color data $R_\gamma'$, $G_\gamma'$, $B_\gamma'$ of the remapped RGB data is obtained by subtracting the white component from the corresponding color data of the remapped RGB data. In this exemplary embodiment, the blue color data $B_\gamma'$ has a minimum luminance that is smaller than $aG_{max}\gamma$. Such while color component extraction may be expressed as in Expression 3.

$$W\gamma' = aG\max^\gamma, \text{if}\,\text{Min}(R'\gamma, G\gamma, B\gamma) \geqq aG\max^\gamma$$

$$W\gamma' = \text{Min}(R'\gamma, G\gamma, B\gamma), \text{others} \qquad \text{Expression 3}$$

Data determining part 14 receives the remapped RGB data from remapping part 12 and the white color component from white extracting part 13 and determines new RGBW data ($R_\gamma$*, $G_\gamma$*, $B_\gamma$*, $W_\gamma$*) based on the input data. Each color data of the new RGBW data is obtained by subtracting the white component from the corresponding color data of the remapped RGB data as described in Expression 4 below. The new RGBW data is then provided to the reverse-gamma converting part 15.

$$R\gamma^* = R\gamma' - W\gamma'$$

$$G\gamma^* = G\gamma' - W\gamma'$$

$$B\gamma^* = B\gamma' - W\gamma'$$

$$W\gamma^* = W\gamma' \qquad \text{Expression 4}$$

Reverse gamma converting part 15 performs reverse-gamma conversion with respect to the respective color data $R_\gamma$*, $G_\gamma$*, $B_\gamma$* and $W_\gamma$* of the new RGBW data provided from the data determining part 14 to generate reverse-gamma converted RGBW gray-scale data $R_\gamma$*, $G_\gamma$*, $B_\gamma$* and $W_\gamma$*. Expression 5 below shows the reverse-gamma conversion performed in the reverse-gamma converting part 15. The compensated RGBW gray-scale data R', G', B' and W' are then provided to pulse width/level converting section 114.

$$R' = \left(\frac{R\gamma^*}{a}\right)^{1/\gamma}$$

$$G = \left(\frac{G\gamma^*}{a}\right)^{1/\gamma}$$

$$B = \left(\frac{B\gamma^*}{a}\right)^{1/\gamma}$$

$$W = \left(\frac{W\gamma^*}{a}\right)^{1/\gamma}$$

Expression 5

Figure 4:
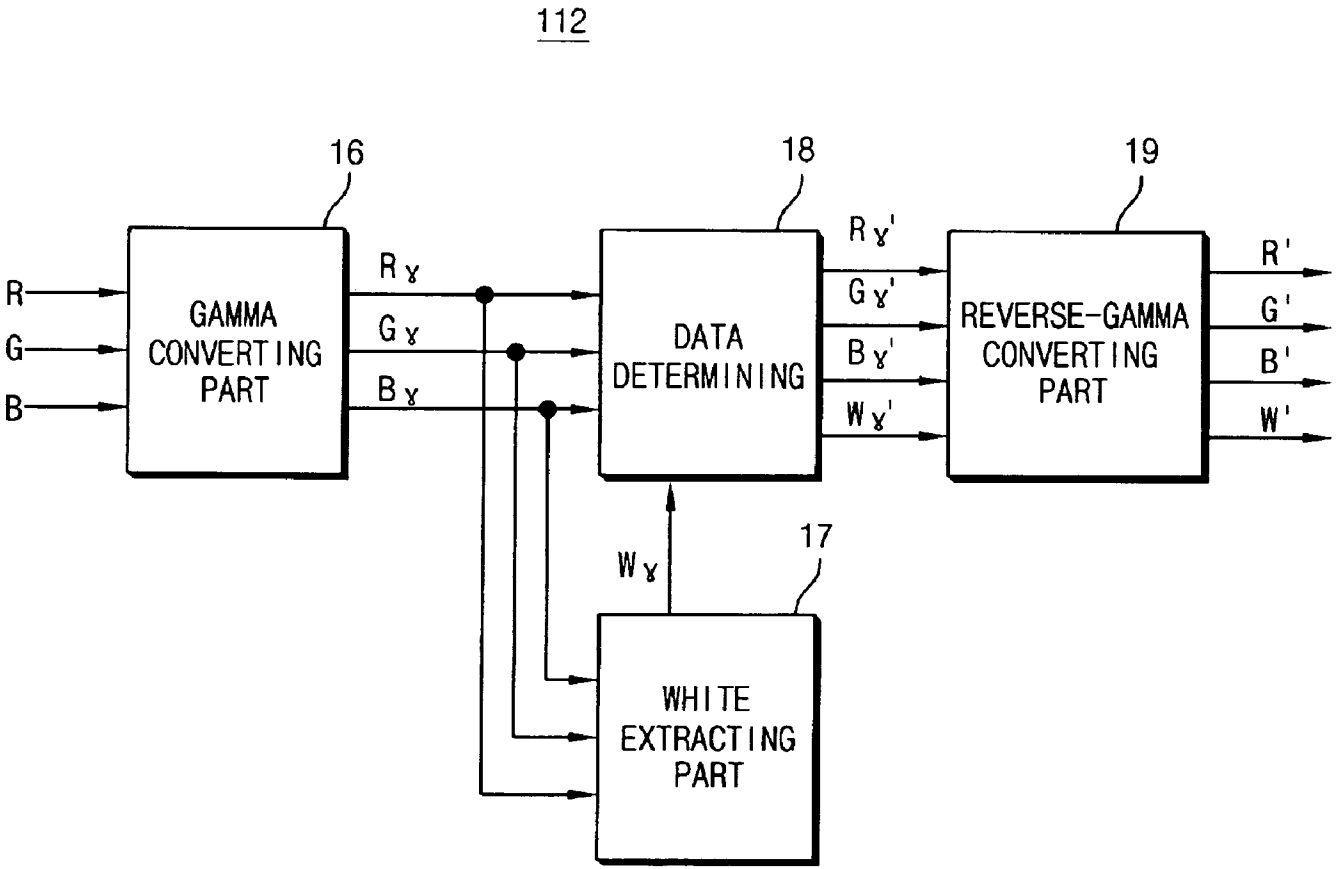
FIG. 4 is a block diagram illustrating another exemplary embodiment of the 4-color converting section in FIG. 1.

FIG. 4 is a block diagram illustrating another exemplary embodiment of the 4-color converting section in FIG. 1.

Referring to FIG. 4, the 4-color converting section 112 includes a gamma converting part 16, a white extracting part 17, a data determining part 18, and a reverse-gamma converting part 19. The 4-color converting section 112 converts original RGB gray-scale data into 4-color RGBW gray-scale data.

Gamma converting part 16, white extracting part 17, data determining part 18 and reverse-gamma converting part 19 are separately described in logical terms for ease of understanding, they are not necessarily separate physical hardware elements.

Gamma converting part 16 receives the original RGB data and converts each color data of the original RGB data into each color data of the gamma-converted RGB data $R_\gamma$, $G_\gamma$, $B_\gamma$ as described in Expression 1 above. The gamma-converted RGB data $R_\gamma$, $G_\gamma$, $B_\gamma$ is then provided to the white extracting part 17 and the data determining part 18.

White extracting part 17 receives the gamma-converted RGB data $R_\gamma$, $G_\gamma$, $B_\gamma$ and extracts the white color component from the gamma-converted RGB data $R_\gamma$, $G_\gamma$, $B_\gamma$. The extracted white color component is then provided to the data determining part 18. That is, the white color component may be determined as the minimum data of the respective color data $R_\gamma$, $G_\gamma$, $B_\gamma$ of the gamma converted RGB data as described in Expression 6 below. The white color component $W_\gamma$ is then provided to the data determining part 18 that also receives the gamma-converted RGB data from the gamma converting part 16.

$$W\gamma = \mathrm{Min}(R\gamma, G\gamma, B\gamma)$$

Expression 6

Data determining part 18 determines each color data $R_\gamma'$, $G_\gamma'$, $B_\gamma'$, $W_\gamma'$ of the new RGBW data based on corresponding color data of the gamma-converted RGB data and the white color component as described in Expression 7 below. The new RGBW data $R_\gamma'$, $G_\gamma'$, $B_\gamma'$, $W_\gamma'$ obtained by the data determining part 18 is then provided to the reverse-gamma compensation part 19.

$$R\gamma' = R\gamma - W\gamma$$

$$G\gamma' = G\gamma' W\gamma$$

$$B\gamma' = B\gamma - W\gamma$$

$$W\gamma' = W\gamma$$

Expression 7

Reverse-gamma compensation part 19 converts each color data $R_\gamma'$, $G_\gamma'$, $B_\gamma'$, $W_\gamma'$ of the RGBW data to generate the corresponding color data R', G', B', W' of the reverse-gamma converted RGBW gray-scale data as described in Expression 8 below. The reverse-gamma converted RGBW data R', G', B', W' is then provided to pulse width/level converting section 114.

$$R' = \left(\frac{R\gamma'}{a}\right)^{1/\gamma}$$

$$G = \left(\frac{G\gamma'}{a}\right)^{1/\gamma}$$

$$B = \left(\frac{B\gamma'}{a}\right)^{1/\gamma}$$

$$W = \left(\frac{W\gamma'}{a}\right)^{1/\gamma}$$

Expression 8

Figure 5:
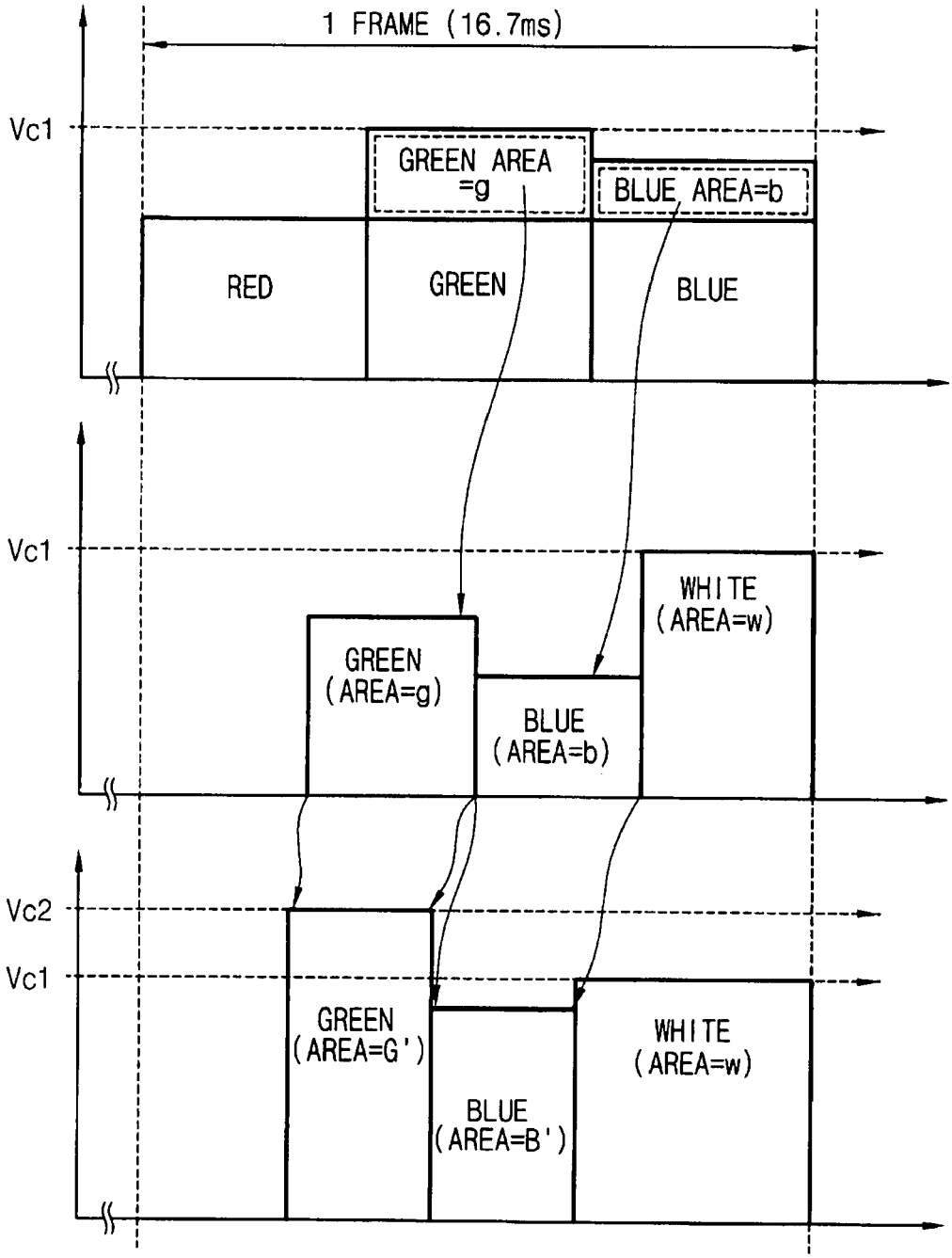
FIG. 5 is a schematic diagram illustrating a generation of RGBW data according to the present invention with respect to RGB data of an original image signal.

FIG. 5 is a schematic diagram illustrating a generation of RGBW data according to the present invention with respect to RGB data of an original image signal. In FIG. 5, the upper graph represents an original image signal, the medium graph represents a 4-color image signal, and a lower graph represents a luminance enhanced image signal according to the present invention. In FIG. 5, X-axis corresponds to one frame, and Y-axis corresponds to a transmittance according to a voltage that is applied to an OCB mode liquid crystal layer. Particularly, a first critical voltage Vc1 corresponding to liquid crystal molecules of a conventional OCB mode LCD apparatus is substantially greater than a second critical voltage Vc2 corresponding to liquid crystal molecules of the OCB mode LCD apparatus according to the present embodiment. A transmittance of the second critical voltage Vc2 is greater than that of the first critical voltage Vc1.

Referring to FIG. 5, RGB data of the original image signals that are adopted for the 3-field driving method are, respectively, to three field intervals divided into same interval during one frame, that is about 16.7 millisecond (ms).

The one frame corresponding to the conventional 4-field driving method includes four field intervals that are divided into same intervals. The RGB data of the same area of the original RGB data are corresponding to the same area of the white data. The RGB data corresponding to a difference of the area are displayed during RGB fields corresponding to the 4-field driving. The area of the RGB data is defined by a field time interval and a threshold voltage, and substantially corresponds to a transmittance.

For example, a color data may not correspond to a red field interval of the R data, and G data corresponding to a first difference area "g" corresponds to a green field interval of the G data. Also, B data corresponding to a second difference area "b" corresponds to a blue field interval of a B data, and the same W data corresponds to a white field interval corresponding to W data.

Accordingly, even though the red LED emits during the red field interval, the black voltage is applied to the liquid crystal layer such that a black image is displayed. For example, when the liquid crystal layer is in an OCB mode, a relatively high voltage is applied to the liquid crystal layer to display black image. During a green field interval following the red field interval, a green LED emits, a predetermined voltage corresponding to the first difference area "g" is applied to the liquid crystal layer such that a green image is displayed. During a blue field interval following the green field interval, a blue LED emits, a predetermined voltage corresponding to the second difference area "b" is applied to the liquid crystal layer such that a blue image is displayed. During a white field interval following the blue field interval, each of the red, green and blue LEDs emits, a predetermined voltage corresponding to the third difference area "w" is applied to the liquid crystal layer such that a white image is displayed.

As described above, RGB colors, that is, 3 colors are displayed just when the LCD apparatus is driven by a 3-field driving method, however 2 colors are displayed just when the LCD apparatus is driven by a 4-field driving method. Therefore, when the LCD apparatus is driven by the 4-field driving method, the color breaking is decreased. Furthermore, the display interval of the white image is greater than the display interval of any given color, so that the luminance of the LCD apparatus is improved.

However, the LCD apparatus of the 4-field driving method has a relatively reduced charging time so the time for the liquid crystal layer to respond is reduced. The response time of the liquid crystal layer will be described in the following FIG. 6.

Figure 6:
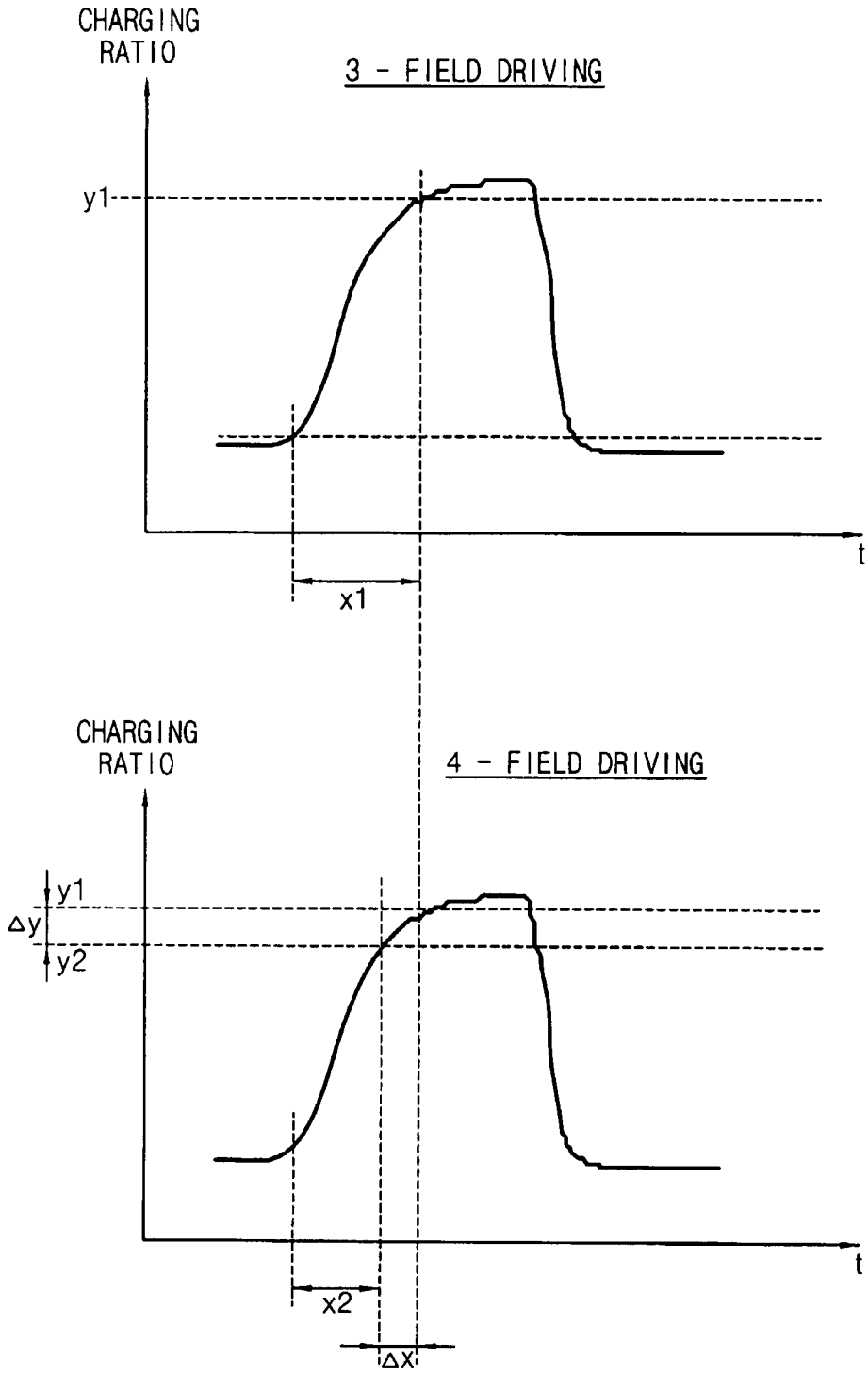
FIG. 6 is a waveform diagram showing a charging characteristic of a liquid crystal layer in accordance with a 3-field driving method and a 4-field driving method.

FIG. 6 is a waveform diagram showing a charging characteristic of a liquid crystal layer in accordance with a 3-field driving method and a 4-field driving method. In FIG. 6, the upper waveform is the charging characteristics of the 3-field driving method and the lower waveform is the charging characteristics of the 4-field driving method.

Referring to FIG. 6, the liquid crystal layer that is driven by the 3-field driving method has a response time of a first time x1 and a first transmittance y1. However, the liquid crystal layer that is driven by the 4-field driving method has a shorter response time x2 to achieve the second transmittance y2 (that is less than y1).

Therefore, when a driving method of the liquid crystal layer is converted from the 3-field driving method to the 4-field driving method, the response time and transmittance of the liquid crystal layer are decreased. That is, the response time of the liquid crystal layer is decreased to $\Delta x(=x1-x2)$, and the transmittance of the liquid crystal layer is decreased to $\Delta y(=y1-y2)$.

As described above, when a driving method of the liquid crystal layer is converted from the 3-field driving method to the 4-field driving method, time interval for a response of the liquid crystal layer is decreased such that a transmittance is reduced.

However, when a liquid crystal layer of a color filter-less LCD apparatus is in an OCB mode liquid crystal layer, the transmittance may be enhanced. This is due to the fact that a field of a black voltage exists in the 4-field driving method. When a field corresponding to the black voltage is applied to the OCB mode LCD apparatus, a critical voltage Vc is decreased such that the transmittance may be enhanced.

FIGS. 7A to 7E are schematic diagrams showing applying methods of various data that is applied to an OCB mode liquid crystal layer. FIG. 8 is a voltage-transmittance (VT) curve of various data that is applied in FIGS. 7A to 7E.

Figure 7A:
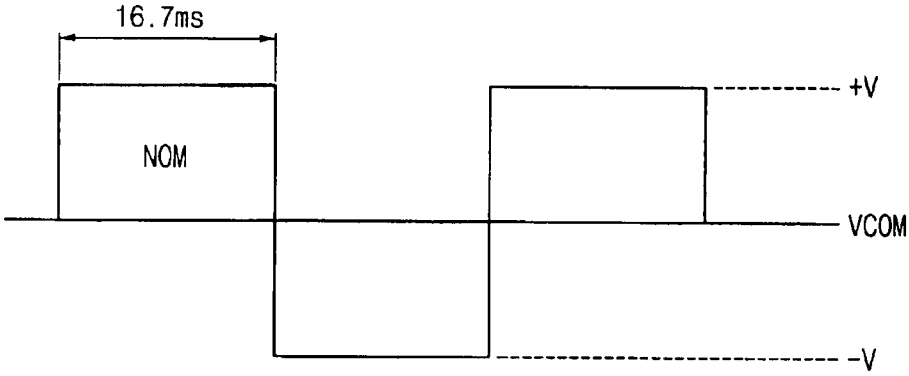
FIGS. 7A to 7E are schematic diagrams showing applying methods of various data that is applied to an OCB mode liquid crystal layer.
Figure 8:
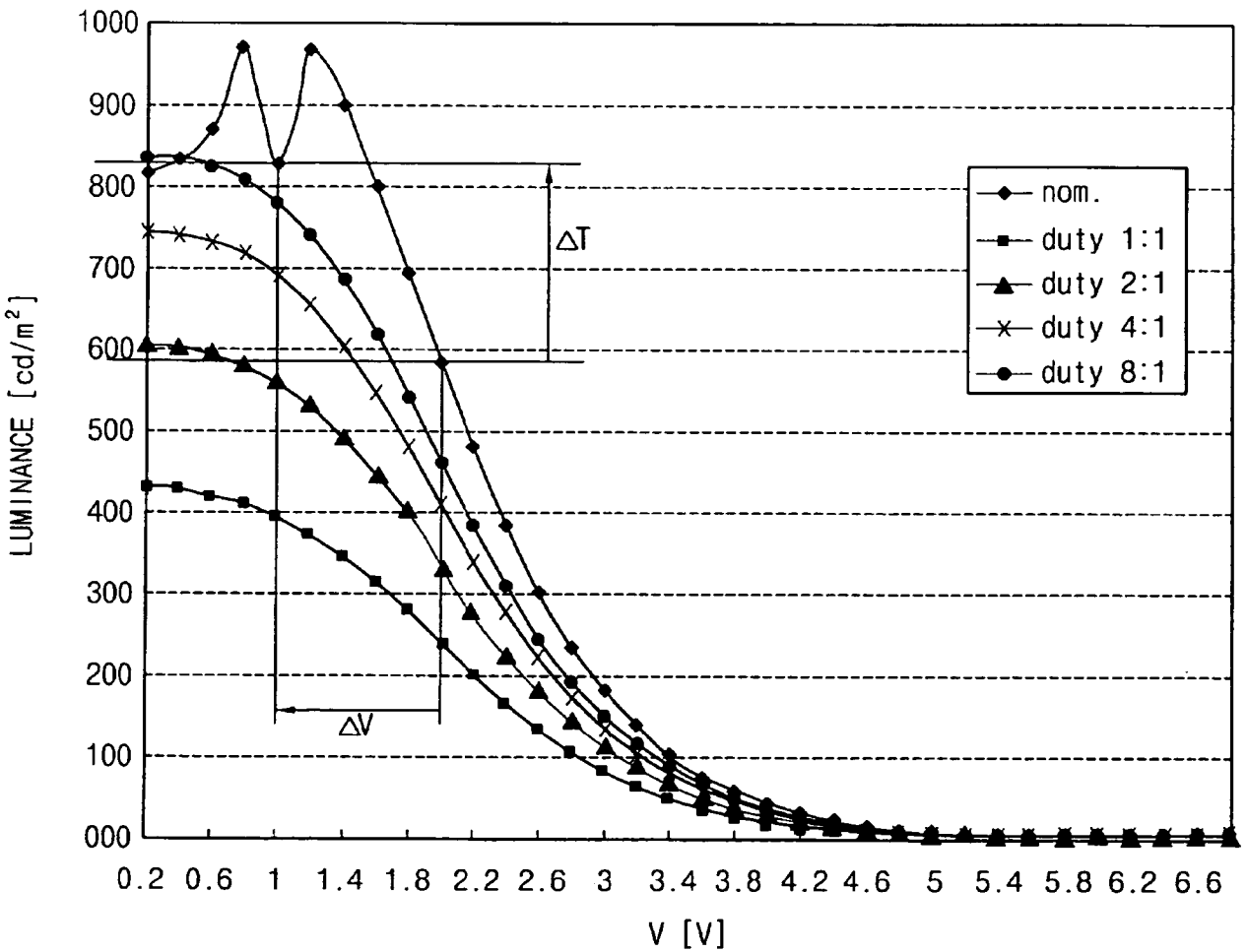
FIG. 8 is a voltage-transmittance (VT) curve of various data that is applied in FIGS. 7A to 7E.

As shown in FIG. 7A, a normal degradation data NOM corresponding to n-numbered frame data is sent to the LCD panel during one frame, that is about 16.7 ms. As shown in FIG. 8, a white gradation voltage is defined as a minimum voltage (about 2V) that is greater than a critical voltage Vc (about 1.8V) and that remains in a bend alignment state. A black gradation voltage is defined as a maximum voltage (about 6V) that remains in a bend alignment state. That is, the white gradation voltage should be greater than the critical voltage Vc in order to drive the LCD apparatus in a static OCB mode.

Figure 7B:
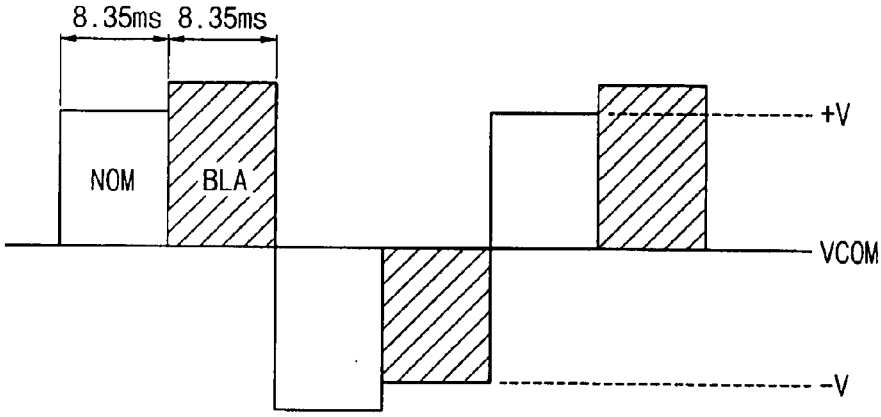

As shown in FIG. 7B, the normal gradation voltage NOM is sent to the LCD panel during an earlier ½ frame period (about 8.35 ms), and a black gradation voltage BLA is sent to the LCD panel during a later ½ frame period (about 8.35 ms). The normal gradation voltage NOM corresponds to n-numbered frame data. The black gradation voltage BLA is used for enhancing a visibility of a moving image. Referring to the VT curve corresponded to a duty cycle of about 1:1 as shown in FIG. 8, the bend state is maintained even though the white gradation voltage is 0V. Here, the duty cycle is defined as a display ratio between a normal image and a black image displayed in a display area of one frame period.

Figure 7C:
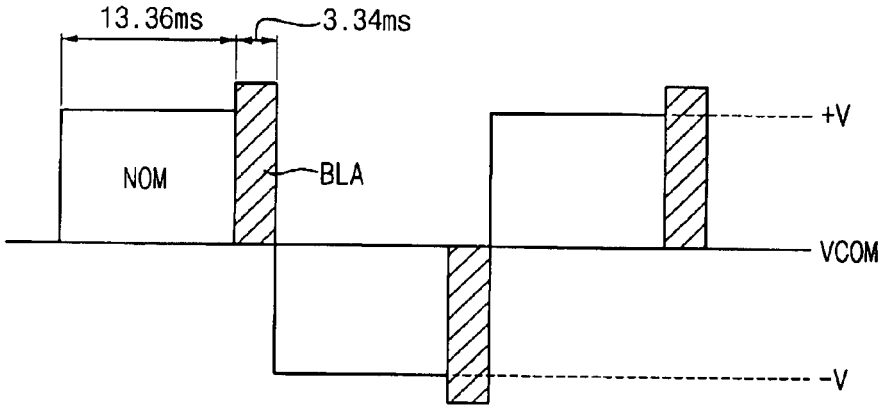

As shown in FIG. 7C, the normal gradation voltage NOM is sent to the LCD panel during an earlier ⅔ frame period (about 12.52 ms), and a black gradation voltage BLA is sent to the LCD panel during a later ⅓ frame period (about 4.18 ms). The normal gradation voltage NOM corresponds to n-numbered frame data. The black gradation voltage BLA is used for enhancing a visibility of a moving image.

Referring to the VT curve corresponded to a duty cycle of about 2:1 as shown in FIG. 8, the bend state is maintained even though the white gradation voltage is 0V. Furthermore, luminance characteristics of the duty cycle of about 2:1 are increased than that of the duty cycle of about 1:1.

Figure 7D:
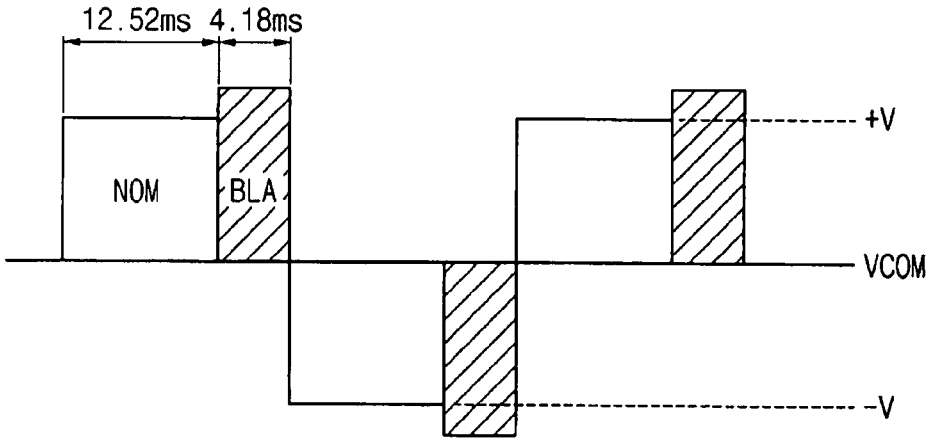

As shown in FIG. 7D, the normal gradation voltage NOM is sent to the LCD panel during an earlier ⅘ frame period (about 13.36 ms), and a black gradation voltage BLA is sent to the LCD panel during a later ⅕ frame period (about 3.34 ms). The normal gradation voltage NOM corresponds to n-numbered frame data. The black gradation voltage BLA is used for enhancing the visibility of the moving image.

Referring to the VT curve corresponding to a duty cycle of about 4:1 as shown in FIG. 8, the bend state is maintained even though the white gradation voltage is 0V. Furthermore, luminance characteristics of the duty cycle of about 4:1 are increased than that of the duty cycle of about 1:1.

Figure 7E:
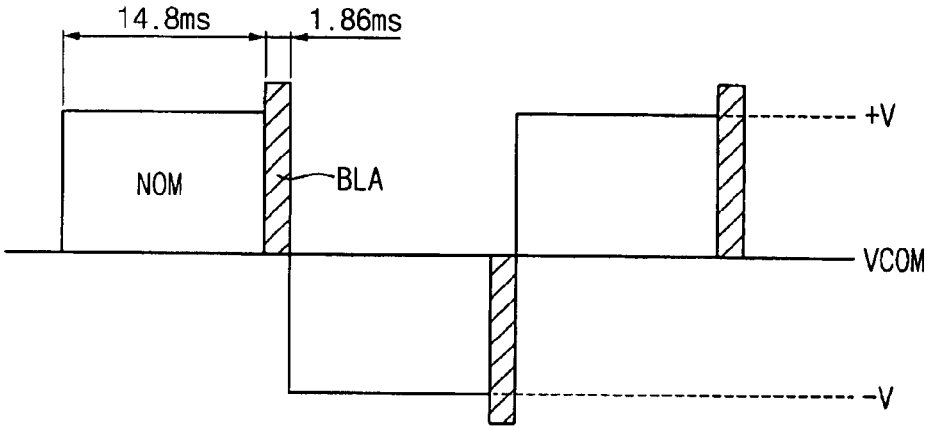

As shown in FIG. 7E, the normal gradation voltage NOM is sent to the LCD panel during an earlier ⅚ frame period (about 14.8 ms), and a black gradation voltage BLA is sent to the LCD panel during a later ⅙ frame period (about 1.86 ms). The normal gradation voltage NOM corresponds to n-numbered frame data. The black gradation voltage BLA is used for enhancing the visibility of the moving image.

Referring to the VT curve corresponded to a duty cycle of about 8:1 as shown in FIG. 8, the bend state is maintained even though the white gradation voltage is 0V. Furthermore, luminance characteristics of the duty cycle of about 8:1 are increased than that of the duty cycle of about 1:1.

In addition, when the one frame is about 16.7 ms, a time interval sent the black gradation voltage BLA is about 1.5 ms to about 8 ms.

In FIGS. 7A to 7E, the normal gradation voltage is sent to the LCD panel, and then the black gradation voltage is sent to the LCD panel. Alternatively, the black gradation voltage may be sent to the LCD panel, and then the normal gradation voltage may be sent to the LCD panel.

Accordingly, in the OCB mode LCD apparatus employing not the conventional driving method but the impulsive driving method according to the present invention, the bend state is maintained even though the white gradation voltage is 0V. In the impulsive driving method, the black gradation voltage is inserted into the one frame.

As described above, when the white field is extended in the 4-field driving method, the transmittance of the OCB mode LCD apparatus is enhanced. However, a number of conditions should be satisfied to extend the white field. This is because a transmittance increasing factor and a transmittance decreasing factor coexist in the OCB mode LCD apparatus.

For example, when the black data is inserted into the one frame of the 4-field driving method, the critical voltage Vc may be decreased or removed. Therefore, a condition that maintains a bend alignment state is satisfied, so that the transmittance of the OCB mode LCD apparatus is increased.

When the white field is extended, the field time interval corresponding to the other colors data, except the white color data, is decreased, however a critical voltage Vc corresponding to the other colors data is fixed. Thus, the size that is defined by the field time interval and the critical voltage is decreased. The size corresponds to a transmittance, so that decreasing the size corresponds to decreasing the transmittance.

Therefore, an optimum condition between a transmittance increasing area and a field increasing area exists in accordance with applying the black data to a frame.

When the LCD apparatus is driven with a normal operation frequency, such as 60 Hz, a variation of a critical voltage Vc and an increasing of luminance according to inserting the black data, is as the following Table 1.

TABLE 1

| Ratio of a black interval (DUTY CYCLE) | Inserting time of a black data | Critical voltage (Vc) |
|---|---|---|
| 50% (1:1) | 8.3 ms | 0.2 V |
| 33% (2:1) | 5.6 ms | 0.2 V |
| 20% (4:1) | 3.3 ms | 0.2 V |
| 11% (8:1) | 1.9 ms | 0.3 V |

As described above in Table 1, when a ratio between the normal data and the black data is 1:1, the inserting time of the black data is about 8.3 ms, and the critical voltage of the OCB mode liquid crystal molecules is about 0.2V. When a ratio between the normal data and the black data is 2:1, the inserting time of the black data is about 5.6 ms, and the critical voltage of the OCB mode liquid crystal molecules is about 0.2V.

When a ratio between the normal data and the black data is 4:1, the inserting time of the black data is about 3.3 ms, and the critical voltage of the OCB mode liquid crystal molecules is about 0.2V. When a ratio between the normal data and the black data is 8:1, the inserting time of the black data is about 1.9 ms, and the critical voltage of the OCB mode liquid crystal molecules is about 0.3V.

In a 4-field driving, a field time interval of each sub-field is about 4.17 ms. When a response speed of the liquid crystal is about 0.5 ms to about 1 ms, no more than about 3 ms is substantially an applying time of the black voltage. That is, a duty cycle of the black interval is about 4:1. When the white field interval is extended in order to enhance the white luminance, each of the field intervals of the RGB data should be maintained at about 2 ms.

That is, when the field times of the RGB data are added up, as shown below.

$$(1.9\text{ ms}+1\text{ ms})\times 3=8.7\text{ ms}$$

Here, '1.9 ms' is an allowable time to insert the black data in the duty cycle 8:1, '1 ms' is a response time of a liquid crystal, and '3' is a number of sub-fields corresponding to each of the RGB data.

When the field times of the RGB data are subtracted from one frame, an extendable time of the white field is calculated as shown below.

$$16.7\text{ ms}-8.7\text{ ms}=8\text{ ms}$$

Here, '16.7 ms' is a time of one frame when the LCD apparatus is driven with a normal operation frequency, such as 60 Hz, '8.7 ms' is a total of minimum requiring time interval of each of the RGB frame, and '8 ms' is a maximum allowable time interval of the white frame.

Therefore, the white field may be extended to about 8 ms.

As described in FIG. 8, a conventional OCB mode LCD apparatus is driven by a full-white voltage of about 2.0V for full-white gradation, because the critical voltage Vc exists in the conventional OCB mode LCD apparatus, which is established for maintaining a bend alignment state of the liquid crystal layer. However, when the impulsive driving method is employed in the OCB mode LCD apparatus, the OCB mode LCD apparatus is driven by a full-white voltage of about 0.2V to about 0.6V.

Therefore, the luminance of the full-white gradation is about 580 cd/m$^2$ in the conventional OCB mode LCD apparatus, however that of the full-white gradation is about 840 cd/m$^2$ in the OCB mode LCD apparatus employing the impulsive driving method. Therefore, a luminance of RGB data according to the present invention is increased to about 44.8% in comparison to a luminance of RGB data according to the conventional OCB mode LCD apparatus.

Figure 9:
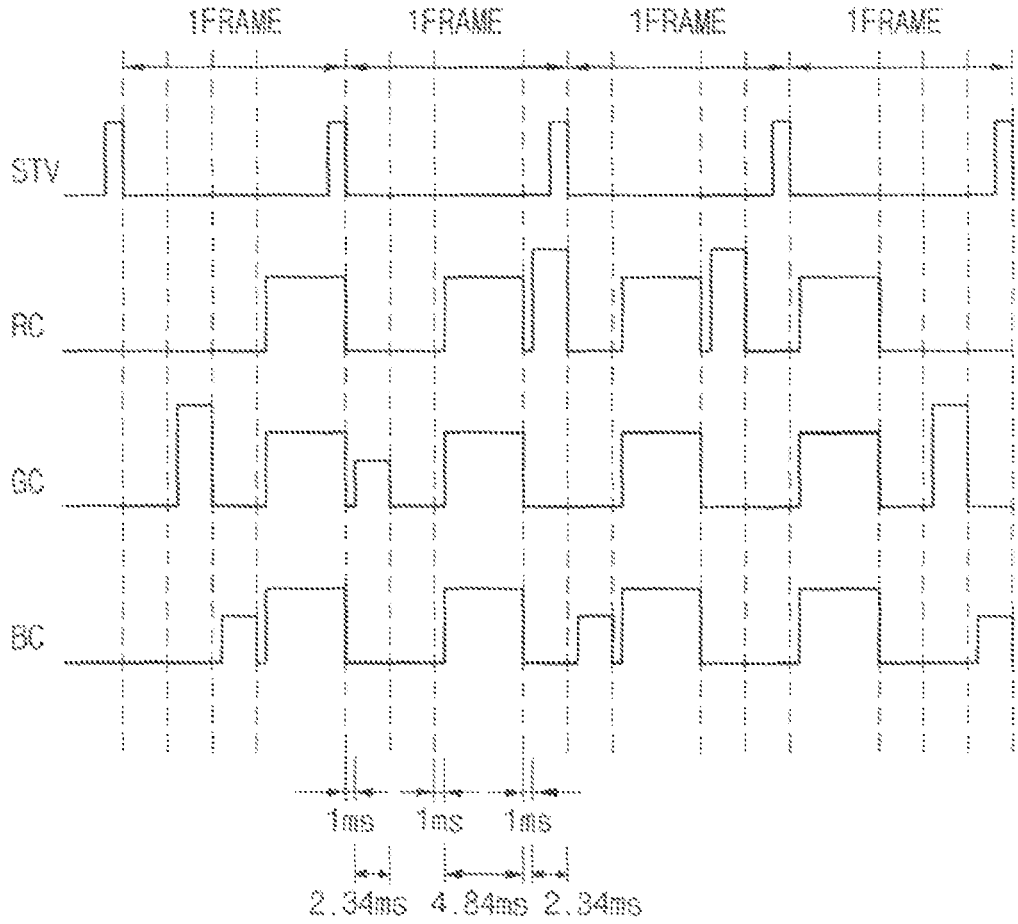
FIG. 9 is a schematic diagram showing an input sequence of RGBW data of the LCD apparatus and an emitting sequence of the RGBW emitting elements.

FIG. 9 is a schematic diagram showing an input sequence of RGBW data of the LCD apparatus and an emitting sequence of the RGBW emitting elements. In FIG. 9, one frame is divided in to five numbers of field intervals.

Referring to FIGS. 1 and 9, timing controller 110 provides the light emitting section 150 with a red light control signal RC, a green light control signal GC and a blue light control signal BC having a ground level, during a first field interval of the first frame. Timing controller 110 provides the light emitting section 150 with the green light control signal GC having a relatively high level, during a second field interval of the first frame. Timing controller 110 provides the light emitting section 150 with the blue light control signal BC having a relatively low level, during a third field interval of the first frame. Timing controller 110 provides the light emitting section 150 with red, green and blue light control signals RC, GC and BC having a relatively medium level, during the fourth field interval and the fifth field interval of the first frame. A total of the first to third field intervals is about 8.7 ms, and a total of the fourth and fifth field intervals is about 8 ms.

Then, timing controller 110 provides light emitting section 150 with a green light control signal GC having a relatively low level, during a first field interval of a second frame. Timing controller 110 provides the light emitting section 150 with a red light control signal RC, a green light control signal GC and a blue light control signal BC having a ground level, during a second field interval of the second frame. Timing controller 110 provides the light emitting section 150 with a red light control signal RC, a green light control signal GC and a blue light control signal BC having a relatively medium level, during a third field interval and a fourth field interval of the second frame. Timing controller 110 provides the light emitting section 150 with the red control signals RC having a relatively high level, during fifth field interval of the second frame. A total of the first, second and fifth field interval is about 8.7 ms, and a total of the third and fourth field interval is about 8 ms.

Then, timing controller 110 provides the light emitting section 150 with a blue light control signal BC having a relatively medium level, during a first field interval of a third frame. Timing controller 110 provides the light emitting section 150 with a red light control signal RC, a green light control signal GC and a blue light control signal BC having a relatively medium level, during a second field interval and a third field interval of the third frame. Timing controller 110 provides the light emitting section 150 with the blue light control signal BC having a relatively high level, during a third field interval of the fourth frame. Timing controller 110 provides the light emitting section 150 with a red light control signal RC, a green light control signal GC and a In blue light control signal BC having a ground level, during fifth field interval of the third frame. A total of the first, fourth and fifth field interval is about 8.7 ms, and a total of the second and third field interval is about 8 ms.

Figure 10:
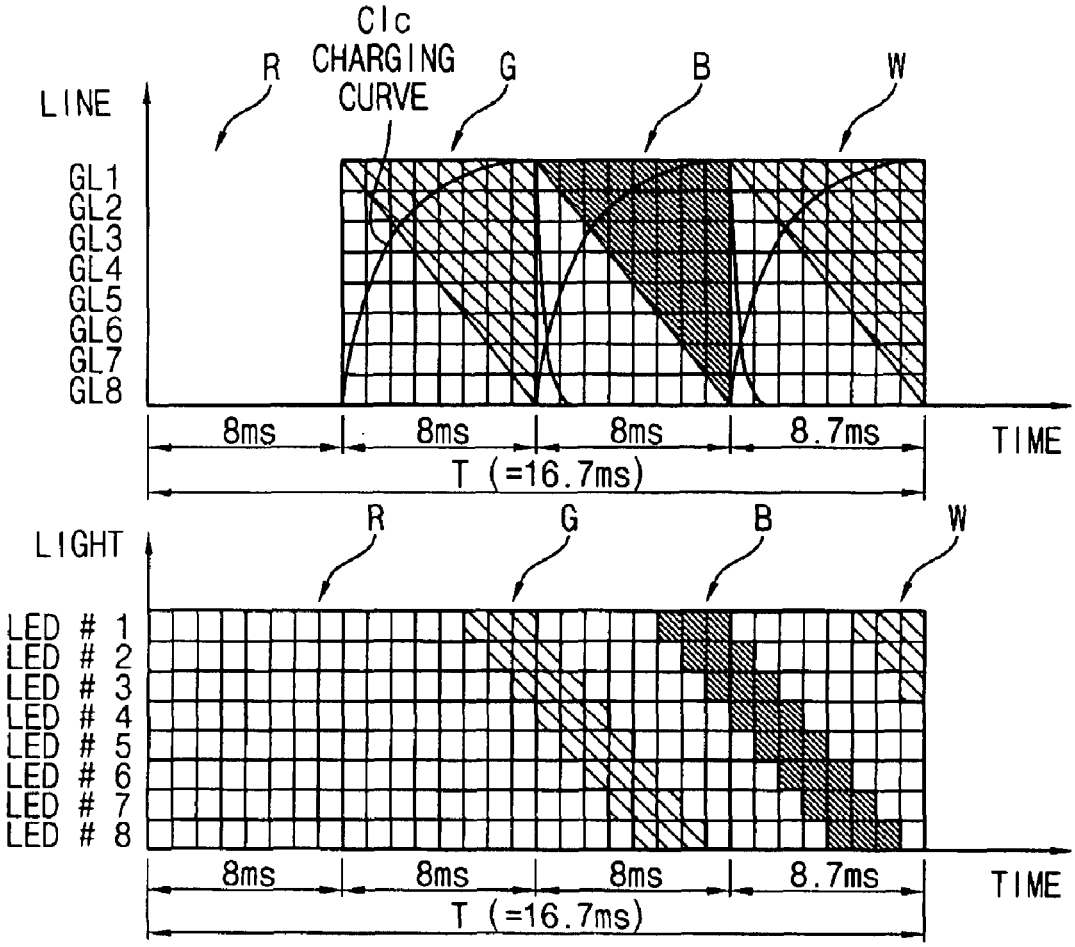
FIG. 10 is a waveform diagram showing an example of an emitting sequence of the emitting element in FIG. 1.

FIG. 10 is a waveform diagram showing an example of an emitting sequence of the emitting elements in FIG. 1. In FIG. 10, the upper graph shows a providing time of the RGB data to a LCD panel 140 including 8×8 pixels, during one frame "T", and the lower graph shows a light emitting sequence of the RGB light emitting elements synchronized to the RGB data. The one frame period "T" includes a first field interval, a second field interval, a third field interval and a fourth field interval.

Referring to FIGS. 1 and 10, no data is applied to the LCD panel 140 during a first field interval of a first frame period. In addition, the light emitting elements that are disposed rear of the LCD panel 140 is not emitted.

Then, a plurality of green data is provided to the LCD panel 140 during a second field interval of the first frame period. When a charging ratio corresponded to the green data of the liquid crystal capacitor Clc is about 90%, the green light emitting element emits a green light beam.

Particularly, during a second field interval of the first frame period, when a green data is charged in a liquid crystal capacitor Clc of a first gate line GL1 and a charging ratio of the green data is about 90%, the green light emitting element emits the green light beam.

Then, when a green data is charged in a liquid crystal capacitor Clc of a second gate line GL2 and a charging ratio of the green data is about 90%, the green light emitting element emits the green light beam.

Similarly, when a green data is charged in a liquid crystal capacitor Clc of an eighth gate line GL8 and a charging ratio of the green data is about 90%, the green light emitting element emits the green light beam.

Then, a plurality of blue data is provided to the LCD panel 140 during a third field interval of the first frame period. When a charging ratio corresponding to the blue data of the liquid crystal capacitor Clc is about 90%, the blue light emitting element emits a blue light beam.

Particularly, during a third field interval of the first frame period, when a blue data is charged in a liquid crystal capacitor Clc of a first gate line GL1 and a charging ratio of the blue data is about 90%, the blue light emitting element emits the blue light beam.

Then, when a blue data is charged in a liquid crystal capacitor Clc of a second gate line GL2 and a charging ratio of the blue data is about 90%, the blue light emitting element emits the blue light beam.

Similarly, when a blue data is charged in a liquid crystal capacitor Clc of a eighth gate line GL8 and a charging ratio of the blue data is about 90%, the blue light emitting element emits the blue light beam.

Then, a plurality of white data is provided to the LCD panel 140 during a fourth field interval of the first frame period. When a charging ration corresponded to the white data of the liquid crystal capacitor Clc is about 90%, the red, green and blue light emitting elements 154R, 154G and 154B simultaneously emit the red, green and blue light beams.

Figure 11:
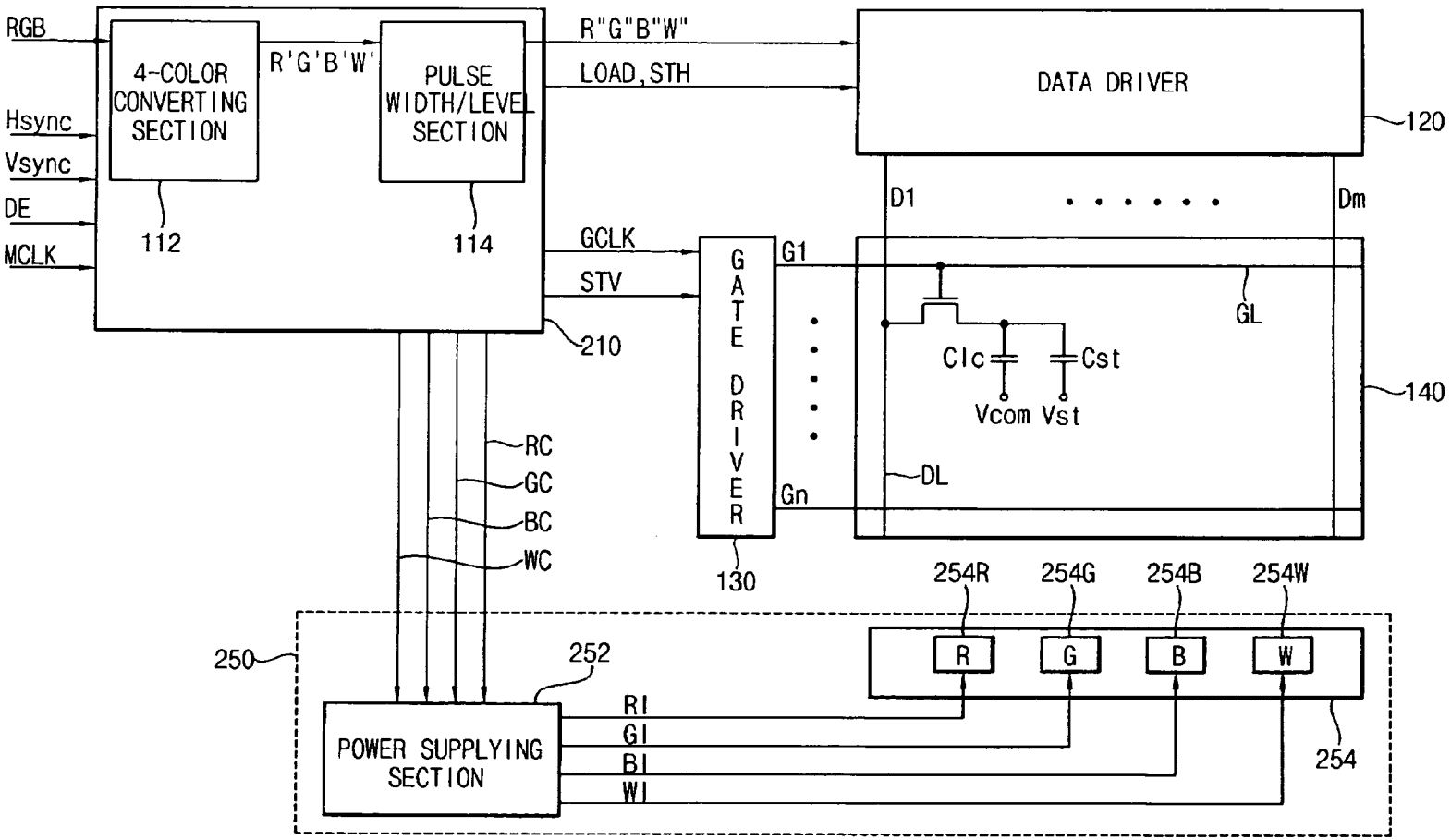
FIG. 11 is a block diagram illustrating a liquid crystal display apparatus according to another exemplary embodiment of the present invention.
Figure 12:
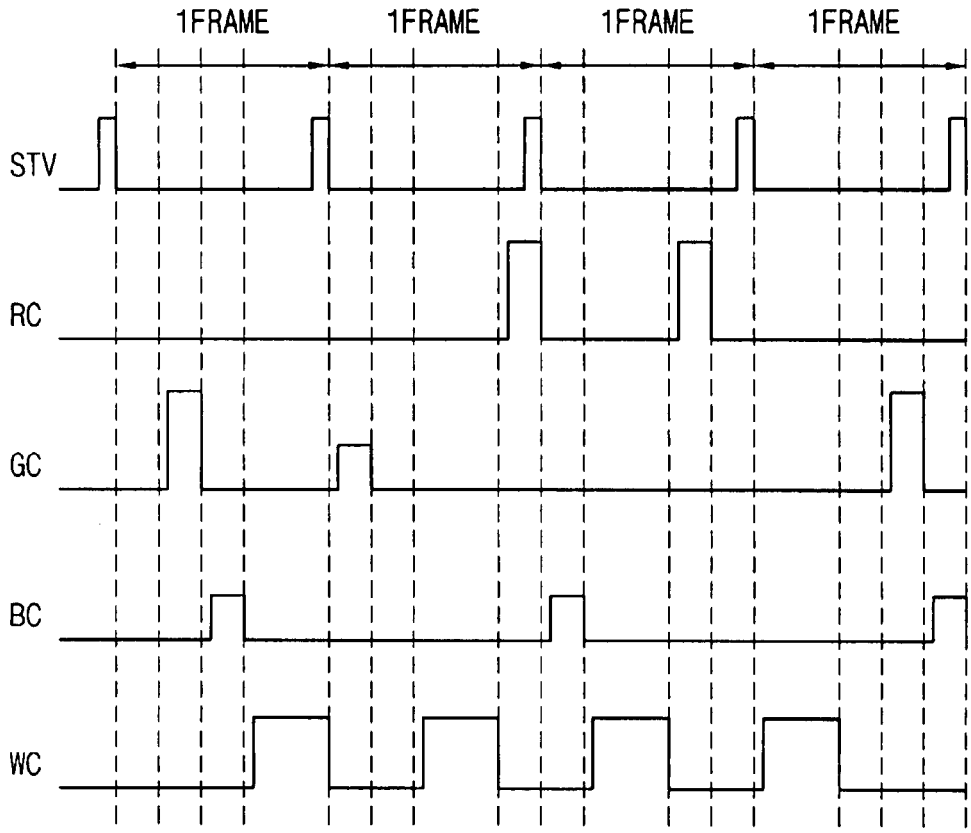
FIG. 12 is a waveform diagram showing an example of an emitting sequence of the emitting element in FIG. 11.

FIG. 11 is a block diagram illustrating a liquid crystal display apparatus according to another exemplary embodiment of the present invention. FIG. 12 is a waveform diagram showing an example of an emitting sequence of the emitting element in FIG. 11. Especially, an LCD apparatus including a backlight assembly having RGBW light emitting elements is illustrated.

Referring to FIGS. 11 and 12, an LCD apparatus according to another exemplary embodiment of the present invention includes a timing controller 210, a data driving section 120, a gate driving section 130, an LCD panel 140 and a light extracting section 250. Referring now in specific detail to FIG. 1 in which the same reference numerals denote the same elements in FIG. 1, and thus any further detailed descriptions concerning the same elements will be omitted.

The timing controller 210 receives an original image signal RGB, various synchronizing signals Hsync and Vsync, a data enable signal DE and a main clock signal MCLK from an external device such as a graphic controller. Here, Hsync denotes a horizontal synchronizing signal, and Vsync denotes a vertical synchronizing signal.

The timing controller 210 provides data driving section 120 with image signals R"G"B"W" having an enhanced luminance and data driving signals LOAD and STH for outputting the image signals R"G"B"W". Here, LOAD controls a loading of the second data signal DATA2, and STH denotes a horizontal start signal that controls a start of one horizontal line.

The timing controller 210 includes, for example, a 4-color converting section 112 and a pulse width/level converting section 114 for converting the original image signal RGB into a luminance enhanced image signal R"G"B"W". The 4-color converting section 112 and pulse width/level converting section 114 of the present embodiment are the same as in FIG. 1. Thus, the same reference numerals will be used to refer to the same or like parts as those described in FIG. 1 and any further explanation concerning the above elements will be omitted.

Timing controller 210 provides the date driving section 130 with gate driving signals GCLK and STV and gate turn-on/off voltages VON and VOFF. Here, GCLK denotes a gate clock signal, and STV denotes a vertical start signal representing a start of one frame.

Timing controller 210 provides light emitting section 250 with a red light control signal RC, a green light control signal GC, a blue light control signal BC and a white light control signal WC in response to the vertical start signal STV. The vertical start signal STV is a synchronization signal that induces a start of one frame. The one frame includes a first field interval, a second field interval, a third field interval and a fourth field interval. When the LCD apparatus is driven by a normal operation frequency of 60 Hz and the white field is disposed at a later of the one frame, a total of the first to third field intervals is about 8.7 ms, and the fourth field is about 8 ms.

For example, as described in FIG. 12, timing controller 210 provides the light emitting section 250 with the red, green, blue and white light control signals RC, GC, BC and WC having a ground level, during the first field interval of the first frame. Timing controller 210 provides the light emitting section 250 with the green light control signal GC having a high level, during the second field interval of the first frame. The timing controller 210 provides the light emitting section 250 with the blue light control signal BC having a high level, during the third field interval of the first frame. Timing controller 210 provides the light emitting section 250 with the white light control signal WC having a high level, during the fourth field interval of the first frame.

Then, timing controller 210 provides the light emitting section 250 with the green light control signal GC having a high level, during the first field interval of the second frame. Timing controller 210 provides the light emitting section 250 with the red, green, blue and white light control signals RC, GC, BC and WC having a ground level, during the second field interval of the second frame. Timing controller 210 provides the light emitting section 250 with the white light control signal WC having a high level, during the third field interval of the second frame. Timing controller 210 provides the light emitting section 250 with the blue light control signal BC having a high level, during the fourth field interval of the second frame.

Then, timing controller 210 provides the light emitting section 250 with the blue light control signal BC having a high level, during the first field interval of the third frame. Timing controller 210 provides light emitting section 250 with the white light control signal WC having a high level, during the second field interval of the third frame. Timing controller 210 provides light emitting section 250 with the red light control signal RC having a high level, during the third field interval of the third frame. Timing controller 210 provides light emitting section 250 with the red, green, blue and white light control signals RC, GC, BC and WC having a ground level, during the fourth field interval of the third frame.

Light emitting section 250 includes a power supplying section 252 and a light emitting part 254. Light emitting section 250 non-sequentially emits a red light beam, a green light beam, a blue light beam and a white light beam in response to the red, green, blue and white light control signals RC, GC, BC and WC provided by the timing controller 210. For example, light emitting section 250 may emit a predetermined light beam during a third field interval of the previous frame, and may emit the predetermined light beam during a second field interval of the present frame. Continuously, light emitting section 250 may emit the predetermined light beam during the first field interval of the next frame.

Power supplying section 252 provides light emitting part 254 with a first current Rl for emitting a red light beam, a second current Gl for emitting a green light beam, a third current Bl for emitting a blue light beam and a fourth current Wl for emitting a white light beam in response to the red, green, blue and white light control signals RC, GC, BC and WC provided by timing controller 210.

Light emitting part 254 includes a red light emitting element 254R, a green light emitting element 254G, a blue light emitting element 254B and a white light emitting element 254W. Light emitting element includes a light emitting diode (LED). The red light emitting element 254R provides the LCD panel 140 with a red light beam in response to the first current Rl. The green light emitting element 254G provides the LCD panel 140 with a green light beam in response to the second current Gl. The blue light emitting element 254B provides the LCD panel 140 with a blue light beam in response to the third current Bl. The white light emitting element 254W provides the LCD panel 140 with a white light beam in response to the fourth current Wl.

As described above, the color filter-less LCD apparatus having a 4-field driving method that emits RGBW data employs an OCB mode liquid crystal, so that the field time interval corresponding to white data is assured. Therefore, response speed, charging ratio and transmittance of the OCB mode liquid crystal molecules are improved.

Although the exemplary embodiments of the present invention have been described, it is understood that various changes and modifications will be apparent to those of ordinary skilled in the art and may be made without, however, departing from the spirit and scope of the invention.

What is claimed is:

1. A liquid crystal display (LCD) apparatus comprising:

an LCD panel including a first substrate, a second substrate and a liquid crystal layer that is between the first substrate and the second substrate; and a driving section providing the LCD panel with a plurality of first image signals based on original RGB gray-scale data during a plurality of first field intervals having the same time interval within a frame, and providing a second image signal to enhance a luminance based on the original RGB gray-scale data during a second field interval that is longer than each of the first field intervals within the frame, wherein the second image signal has a level substantially equal to a maximum level of the original RGB gray-scale data, and the first image signal has two color gray-scale data in which a gray-scale data corresponding to a minimum level is excluded, wherein one of the two color gray-scale data has a level and a width which define a size substantially equal to a size defined by a level exceeding the minimum level and a width of a corresponding gray-scale data, and another of the two color gray-scale data has a level and a width which define a size substantially equal to a size defined by a level exceeding the minimum level and a width of a corresponding gray-scale data, wherein the second image signal has a width greater than respective widths of the two color gray-scale data, and the maximum level of the original RGB gray-scale data with respect to the second image signal remains the same, wherein the levels of the two color gray-scale data are increased in proportion to the decrease of the widths, wherein the first image signals include a red data, a green data and a blue data, and the second image signal includes a white data, and wherein the applying time of each of the red, green and blue data is less than or equal to about ¼ frame, and the applying time of the white data is greater than about ¼ frame.

2. The LCD apparatus of claim 1, wherein the liquid crystal layer is an optical compensated birefringence (OCB) mode liquid crystal layer.

3. The LCD apparatus of claim 1, wherein each of the first image signals further includes a black data.

4. The LCD apparatus of claim 1, wherein two data of the red data, the green data and the blue data are sent to the LCD panel during a field interval.

5. The LCD apparatus of claim 1, wherein the applying time of the white data is longer than or equal to about 4.175 ms, and is shorter than or equal to about 8.0 ms.

6. The LCD apparatus of claim 1, wherein the driving section comprises:

a timing controller generating a first image data from the original image signal, and generating a second image data based on the first image data;

a gate driving section outputting a plurality of gate signals activating a plurality of gate lines formed on the first substrate; and a data driving section converting each of the first and second image data into the first and second image signals, respectively, and providing the LCD panel with the first and second image signals.

7. The LCD apparatus of claim 1, wherein the second field interval is earlier or later than the first field intervals.

8. The LCD apparatus of claim 1, wherein the second field interval is between two adjacent first field intervals.

9. The LCD apparatus of claim 1, further comprising a light providing section providing the LCD panel with a plurality of light beams of different wavelengths, the different wavelengths corresponding to the first and second image signals.

10. The LCD apparatus of claim 9, wherein the first image signals include a red data, a green data and a blue data, and the second image signal includes a white data, wherein the light providing section includes a red emitting element emitting a red light beam corresponding to the red data, a green emitting element emitting a green light beam corresponding to the green data, and a blue emitting element emitting a blue light beam corresponding to the blue data.

11. The LCD apparatus of claim 10, wherein the red, green and blue emitting elements respectively emit a red light beam, a green light beam and blue light beam during three field intervals among five field intervals that are divided from the one frame, and emit a white light beam during the remained two field intervals.

12. The LCD apparatus of claim 11, wherein the red, green and blue light emitting elements emit a red light beam, a green light beam and blue light beam, respectively, for about 2.34 ms during each of the three field intervals, and emits a white light beam through a mixture of a red light beam, a green light beam and a blue light beam during about 4.84 ms of the remaining two field intervals.

13. A method for driving a liquid crystal display (LCD) apparatus including a plurality of gate lines, a plurality of data lines and a pixel connected to adjacent data lines and adjacent gate lines, the method comprising:

outputting a first image signal based on original RGB gray-scale data and a gate signal for charging the first image signal to the pixel during a plurality of first field intervals within a frame; and outputting a second image signal for enhancing a luminance based on the original RGB gray-scale data and a gate signal for charging the second image signal to the pixel during a second field interval that is longer than the first time interval within the frame, wherein the second image signal has a level substantially equal to a maximum level of the original RGB gray-scale data, and the first image signal has two color gray-scale data in which a gray-scale data corresponding to a minimum level is excluded, wherein one of the two color gray-scale data has a level and a width which define a size substantially equal to a size defined by a level exceeding the minimum level and a width of a corresponding gray-scale data, and another of the two color gray-scale data has a level and a width which define a size substantially equal to a size defined by a level exceeding the minimum level and a width of a corresponding gray-scale data, wherein the second image signal has a width greater than respective widths of the two color gray-scale data, and the maximum level of the original RGB gray-scale data with respect to the second image signal remains the same, wherein the levels of two color gray-scale data are increased in proportion to the decrease of the widths, wherein the first image signals include a red data, a green data and a blue data, and the second image signal includes a white data, and wherein the applying time of each of the red, green and blue data is less than or equal to about ¼ frame, and the applying time of the white data is greater than about ¼ frame.

14. The method of claim 13, wherein the second field interval is longer than the first field interval.

15. The method of claim 13, wherein the original image signal comprises a red data of a first level, a green data of a second level and a blue data of a third level, and the second field interval is defined by a data having a minimum level of the first, second and third levels.

16. The method of claim 13, wherein the original image signal comprises a first color data of a first level, a second color data of a second level and a third color data of a third level, and a voltage level of the second image signal is equal to a voltage level corresponding to a data of a minimum level of the first, second and third color data.

17. The method of claim 13, wherein the outputting a first image signal comprising:

receiving the original image signal;

extracting a first color data having the minimum charging quantity from the original image data;

subtracting a charging quantity of the first color data from each of a remaining color data of the original image signal;

defining a charging level of the remaining color data that corresponds to the subtracted charging quantity and the first field interval; and outputting the remaining color data having the defined charging level to the data line during the first field interval.

18. The method of claim 13, wherein the outputting a second image signal comprising:

defining a charging level and the second image signal, the charging level corresponding to the minimum charging quantity, and the second image signal corresponding to the second field interval; and outputting the second image signal having the defined charging level to the data line during the second field interval.

19. The method of claim 18, wherein the charging quantity is defined by a charging time and a charging level, where the charging times are the same and the charging levels are different.

20. A method for driving a liquid crystal display (LCD) apparatus including an LCD panel having a first substrate, a second substrate and a liquid crystal layer that is between the first substrate and the second substrate, the method of driving the LCD apparatus comprising:

sequentially providing the LCD panel with a plurality of light beams having different wavelength bands from each other considering a first image signal that is generated based on original RGB gray-scale data; and providing the LCD panel with a light beam for enhancing luminance considering a second image signal that is generated to enhance a luminance based on the original RGB gray-scale data, wherein the second image signal has a level substantially equal to a maximum level of the original RGB gray-scale data, and the first image signal has two color gray-scale data in which a gray-scale data corresponding to a minimum level is excluded, wherein one of the two color gray-scale data has a level and a width which define a size substantially equal to a size defined by a level exceeding the minimum level and a width of a corresponding gray-scale data, and another of the two color gray-scale data has a level and a width which define a size substantially equal to a size defined by a level exceeding the minimum level and a width of a corresponding gray-scale data, wherein the second image signal has a width greater than respective widths of the two color gray-scale data, and the maximum level of the original RGB gray-scale data with respect to the second image signal remains the same, wherein the levels of the two color gray-scale data are increased in proportion to the decrease of the widths, wherein the first image signals include a red data, a green data and a blue data, and the second image signal includes a white data, and wherein the applying time of each of the red, green and blue data is less than or equal to about ¼ frame, and the applying time of the white data is greater than about ¼ frame.

* * * * *